US006260989B1

(12) United States Patent
Ingraselino

(10) Patent No.: US 6,260,989 B1
(45) Date of Patent: Jul. 17, 2001

(54) SYNCHRONIZED CONFETTI SPRAYER AND DESCENDING ILLUMINATED BALL

(76) Inventor: Joseph V Ingraselino, 72 Yale Ave., Oakdale, NY (US) 11769

( * ) Notice: Subject to any disclaimer, the term of this patent is extended or adjusted under 35 U.S.C. 154(b) by 0 days.

(21) Appl. No.: 09/505,564

(22) Filed: Feb. 17, 2000

(51) Int. Cl.[7] ..... A63H 33/00; A63H 33/26

(52) U.S. Cl. ..... 362/383; 362/362; 362/287; 362/431; 362/414; 362/418; 362/806; 362/253; 362/249; 362/250; 362/86; 362/386; 362/553; 362/809; 362/363; 362/393; 446/429; 446/475

(58) Field of Search ..... 362/362, 287, 362/431, 410, 414, 418, 806, 253, 249, 250, 86, 386, 553, 809, 363, 393; 446/429, 475; 222/5

(56) References Cited

U.S. PATENT DOCUMENTS

| | | | | |
|---|---|---|---|---|
| 2,608,779 | * | 9/1952 | Joy | 362/363 |
| 3,686,498 | * | 8/1972 | Meyer | 240/84 |
| 4,389,598 | | 6/1983 | Smith . | |
| 4,993,986 | * | 2/1991 | Bloomfield | 446/484 |
| 5,090,789 | | 2/1992 | Crabtree . | |
| 5,149,290 | * | 9/1992 | Reeven | 446/475 |
| 5,240,452 | | 8/1993 | Wen . | |
| 5,324,224 | * | 6/1994 | Anderson et al. | 362/809 |
| 5,601,361 | | 2/1997 | Lawrence . | |
| 5,655,325 | * | 8/1997 | Watkins | 446/475 |
| 5,846,070 | * | 12/1998 | Kim et al. | 362/812 |
| 5,954,563 | * | 9/1999 | Spriggs | 446/475 |
| 6,076,946 | * | 6/2000 | Brouillette, III et al. | 362/362 |

* cited by examiner

*Primary Examiner*—Sandra O'Shea
*Assistant Examiner*—Anabel M Ton
(74) *Attorney, Agent, or Firm*—Michael I Kroll

(57) ABSTRACT

The present invention 10 discloses an illuminated celebratory device having a confetti blower housing 22 with LED digital display 14 and other visual and sound effects 24, 26, 28, 30, and 32 mounted on top of a vertically standing pole 20 having tracks 18 thereon upon which a movable ball 12 is slidably mounted. The ball 12 also has digital displays 15, 16 and lamps 36 thereon. The pole 20 is mounted on a base stand 46. In operation, at a predetermined time, the ball 12 begins its descent from atop the pole 20 and as it descends pole lamps 38 illuminate and the LED's 14, 15, 16 show the appropriate time. When the ball 12 reaches its destination at the bottom of pole 20, the LED's indicate the appropriate time and all celebratory features of the device activate.

15 Claims, 4 Drawing Sheets

SYNCHRONIZED CONFETTI SPRAYER AND DESCENDING ILLUMINATED BALL

BACKGROUND OF THE INVENTION

1. Field of the Invention

The present invention relates generally to illuminated celebratory devices and, more specifically to a synchronized confetti sprayer and descending illuminated ball having a digital display counting down the seconds until a predetermined time that the ball will reach the bottom of a vertical support post thereby activating the confetti sprayer, noisemakers, and flashing lights to announce the onset of a celebration.

2. Description of the Prior Art

There are other illuminated devices designed for celebrations. Typical of these is U.S. Pat. No. 5,601,361 issued to Lonnie Lawrence on Feb. 11, 1997.

Another patent was issued to Elizabeth Wen on Aug. 31, 1993 as U.S. Pat. No. 5,240,452. Yet another U.S. Pat. No. 5,090,789 was issued to Allen E. Crabtree on Feb. 25, 1992 and still yet another was issued on Jun. 21, 1983 to Robert M. Smith as U.S. Pat. No. 4,389,598.

U.S. Pat. No. 5,601,361

Inventor: Lonnie Lawrence

Issued: Feb. 11, 1997

A movable and flexible net arranged in an M×N pattern is set forth. The pattern is defined by a plurality of parallel strands having eyelets therein to releasably engage and hold lamps in a light string. The net of the present disclosure, while supporting an attached light string, can be draped to any contour determined by a supportive surface, and can be likewise positioned in a deployed pattern with that contour or stored for later use. The net in the M×N rectangular pattern is formed of flexible strands to enable storage.

U.S. Pat. No. 5,240,452

Inventor: Elizabeth Wen

Issued: Aug. 31, 1993

A confetti tossing apparatus. Lengths of folded paper are fixedly attached between end panels and a body of confetti is disposed within the lengths of folded paper. The apparatus opens to a first position to display a first part of a celebratory greeting, for example the word "HAPPY" '. The apparatus is jerked while holding the end panels causing the apparatus to open to a second position. A second part of the celebratory greeting for example the word "BIRTHDAY" is displayed in conjunction with the first part of the greeting, and the opening of the apparatus to its second position causes confetti to be tossed outwardly from the apparatus.

U.S. Pat. No. 5,090,789

Inventor: Allen E. Crabtree

Issued: Feb. 25, 1992

A laser light show device and method produces a surface projected or suspended holographic image, and includes multiple image projectors. One image projector provides the object image information representing the primary subject. For surface projections, additional background image projectors provide background image information generated using a wobbler plate-reflected beam diffracted through a spherical lens, a beam undimensionally diffracted through a rotating cylindrical amorphic dipolyhedral, and a beam diffracted through multiple diffraction gratings. A suspended holographic is produced by parabolically focusing multiple images projected onto a spherical image screen.

U.S. Pat. No. 4,389,598

Inventor: Robert M. Smith

Issued: Jun. 21, 1983

A disco light assembly which includes a multiplicity of individual electric lamps formed in a circle, or in any other appropriate configuration, and which are illuminated in any desired sequence in response to a disco beat. The individual lamps are preferably of the high intensity type, and each generates a shaft of light, preferably white, when illuminated. A common regulated power supply is provided which supplies a continuous filament current to all the lamps which is of sufficient amplitude to maintain the filaments in a warm state but insufficient to illuminate the lamps. Each lamp has its own control module connected to the common power supply, and when a module is triggered, it causes a high current pulse to be introduced to the corresponding lamp for a few milliseconds, followed by a power current of sufficient intensity to illuminate the lamp. The power current continues for so long as the lamp is to be illuminated. A rapid turn-on circuit is included in each module, so that each lamp is turned on without creating any undue thermal stress in the lamp filament. However, the lamps turn off at a relatively slow rate. This obviates irritating strobe light effects.

While these illuminated celebratory devices may be suitable for the purposes for which they were designed, they would not be as suitable for the purposes of the present invention, as hereinafter described.

SUMMARY OF THE PRESENT INVENTION

The present invention discloses an illuminated celebratory device having a confetti blower housing with LED digital display and other visual and sound effects mounted on top of a vertically standing pole having tracks thereon upon which a movable ball is slidably mounted. The ball also has digital displays and lamps thereon. The pole is mounted on a base stand. In operation, at a predetermined time, the ball begins its descent from atop the pole and as it descends pole lamps illuminate and the LED's show the appropriate time. When the ball reaches its destination at the bottom of pole, the LED's indicate the appropriate time and all celebratory features of the device activate.

A primary object of the present invention is to provide a synchronized confetti sprayer and descending illuminated ball wherein the ball reaches the bottom of its vertical support post precisely at a predetermined time whereupon lights throughout the device will start flashing as noisemakers go off and confetti and glitter is expelled from the uppermost portion to announce the onset of the celebration.

Another object of the present invention is to provide a synchronized confetti sprayer and descending illuminated ball having a multiplicity of lamps on or within the surface of the ball and at least one digital display to provide a 10-second countdown to the event as the ball is descending Yet another object of the present invention is to provide a synchronized confetti sprayer and descending illuminated ball wherein the vertical support consists of: a vertical pole having a series of lamps located therein and a tracking mechanism to guide the movement of the ball; a base subjacent to the vertical pole to house the ball drive mechanism and provide stability to the celebratory device; and a confetti blower housing located at the apex of the vertical pole.

Still yet another object of the present invention is to provide a synchronized confetti sprayer and descending illuminated ball having a confetti blower housing containing an external, programmable digital display screen, a confetti/glitter blower, noisemaking devices such as a P.A. system, sirens, amplified caps, etc., and top-mounted lights or lasers to enhance the reflective properties of the confetti and glitter.

Yet another object of the present invention is to provide a confetti sprayer and descending illuminated ball for a synchronized descent whereby the ball reaches its nadir at a predetermined time and activates the confetti, noisemakers and lights to signal the onset of the celebration.

Still another object of the present invention is to provide a synchronized confetti sprayer and descending illuminated ball having a microprocessor to allow an operator to program the digital display on the confetti blower housing accordingly, i.e. "HAPPY NEW YEAR", "2001" "HAPPY BIRTHDAY", etc.

Another object of the present invention is to provide a synchronized confetti sprayer and descending illuminated ball having a microprocessor to allow an operator to program the individual light systems of the confetti blower housing, the vertical pole, and the illuminated ball to activate sequentially, steady on, flashing, or as a rapid strobe as the ball passes through its points of operation.

A further object of the present invention is to provide a synchronized confetti sprayer and descending illuminated ball including a timing device to assure the synchronicity of the ball reaching its destination and the activation of lights, noisemakers and confetti with the accurate moment to be celebrated.

A still further object of the present invention is to provide a synchronized confetti sprayer and descending illuminated ball including a timing device with cable and internet interface capabilities to assure accurate timekeeping. The cable and internet connections could also be used to broadcast feeds over the P.A. system Additional objects of the present invention will appear as the description proceeds.

The present invention overcomes the shortcomings of the prior art by providing a confetti sprayer with a descending illuminated digital display ball including a timing device to assure the synchronization of the ball reaching its destination at the precise moment of celebration and setting off flashing lights, noisemakers, and confetti.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

LIST OF REFERENCE NUMERALS

Figure 1:
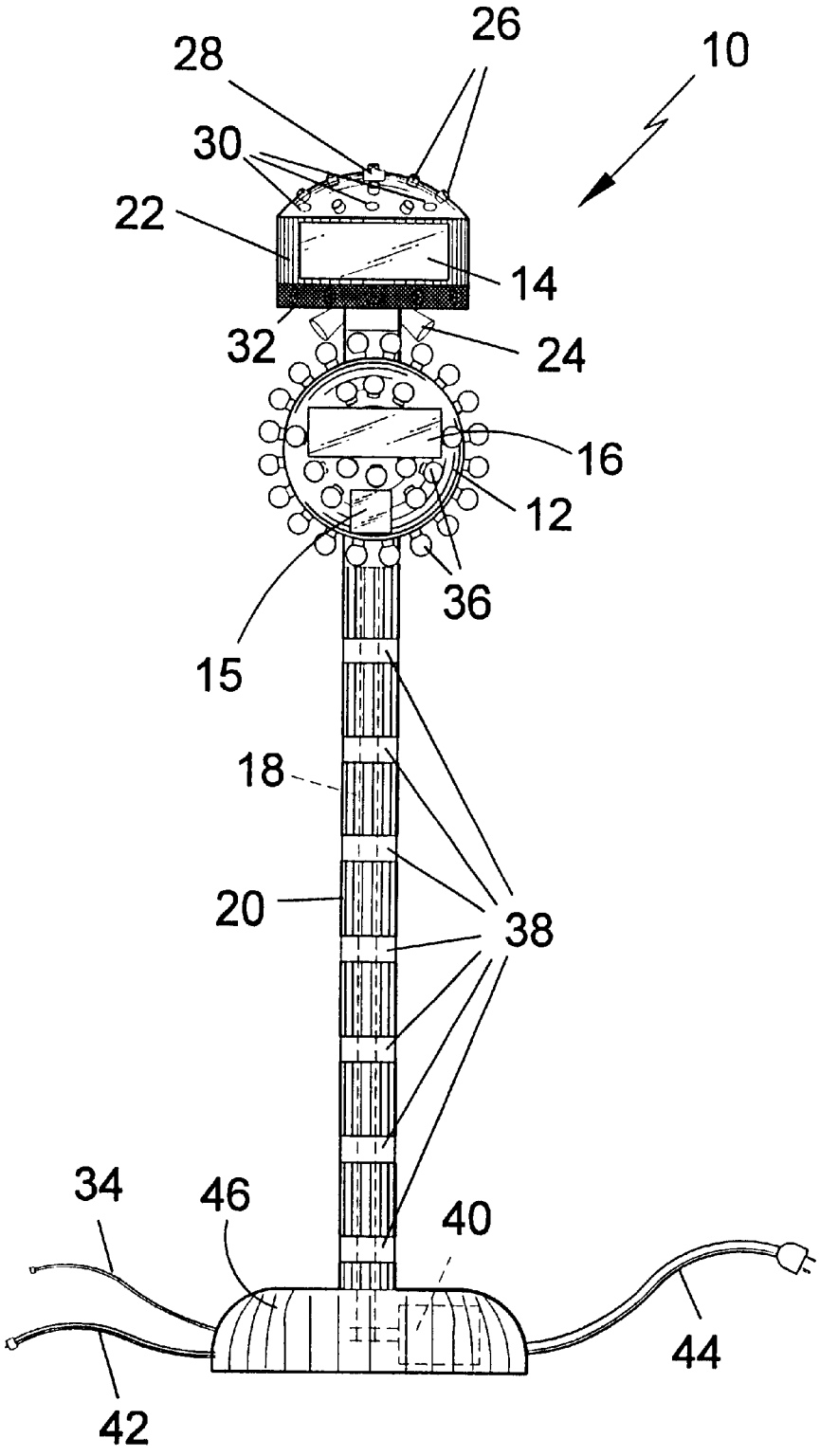
FIG. 1 is a front view of the present invention when dormant showing the ball in the raised ready position with two LED displays. A track mechanism runs through the vertical pole and is shown in hidden line. The confetti blower housing has an external LED display, sirens, confetti cannons, a laser generator, and a P.A. system with amplifier and speakers that could be used with a microphone, CD, internet feed, etc.

With regard to reference numerals used, the following numbering is used throughout the drawings.

10 present invention
12 ball
14 LED
15 LED
16 LED
18 track mechanism
20 vertical support pole
22 confetti blower housing
24 sirens
26 confetti nozzle
28 laser generator
30 halogen lamps
32 P.A. system
34 computer internet feed
36 ball lamps
38 pole lamps
40 ball drive mechanism
42 cable connection
44 power source
46 confetti/glitter
48 laser lights
50 halogen lights
52 sound waves

DESCRIPTION OF THE PREFERRED EMBODIMENT(S)

In order that the invention may be more fully understood, it will now be described, by way of example, with reference to the accompanying drawings in which FIGS. 1 through 4 illustrate the present invention being a synchronized confetti sprayer and descending illuminated ball.

Turning to FIG. 1, shown therein is a front view of the present invention 10 when dormant showing the ball 12 in the raised ready position with two LED displays 14, 15, 16. A track mechanism 18 which guides the ball during its descent runs through the vertical support pole 20 and is shown in hidden line. The confetti blower housing 22 has an it external LED message display board 14, sirens 24, confetti cannons 26 with a fan blower, a laser generator 28, halogen lamps 30, and a P.A. system 32 with amplifier and speakers that could be used with a microphone, CD player, internet feed 34, etc. A means for connection to the internet 34 could be used to assure accurate time by making connection to an internet timekeeping web site. Also shown are ball lamps 36 along with pole lamps 38, ball drive mechanism 40, cable connection 42 and power source 44. A means for connecting 42 to a cable TV could use the cable connection to set the correct time and to allow a broadcast feed to be announced over the PA system. Pole base stand 46 is also shown.

Figure 2:
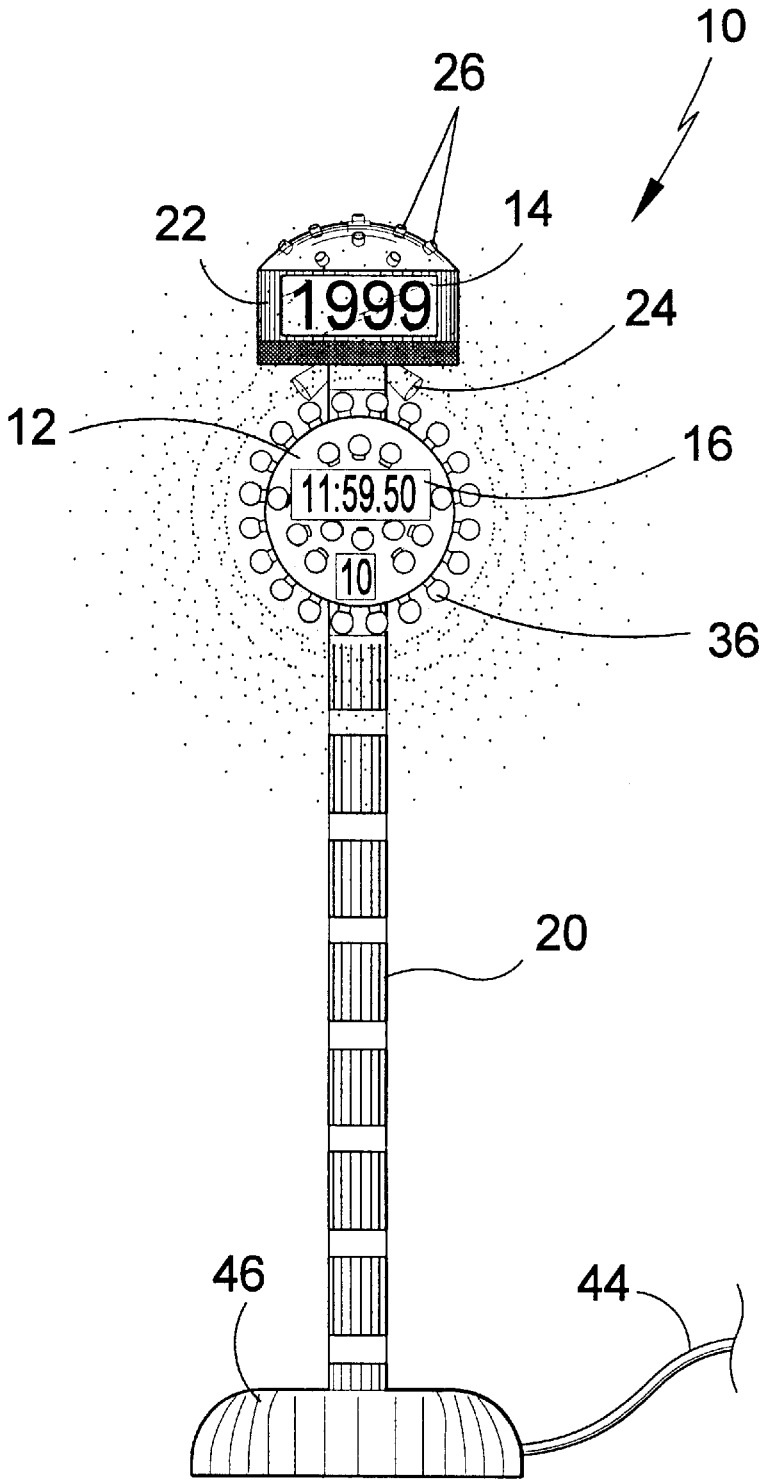
FIG. 2 is a front view of the present invention activated. The ball lamps are lit and the digital displays have been set accordingly to reflect the year, time, and seconds remaining until the new year. The ball is ready to begin its 10 second descent down the vertical support post.

Turning to FIG. 2, shown therein is a front view of the present invention 10 activated. The ball lamps 36 are lit and the digital displays 14, 16 have been set accordingly to reflect the year, time, and seconds remaining until the new year. The ball 12 is ready to begin its 10 second descent down the vertical support post 20. Elements previously disclosed are also shown.

Figure 3:
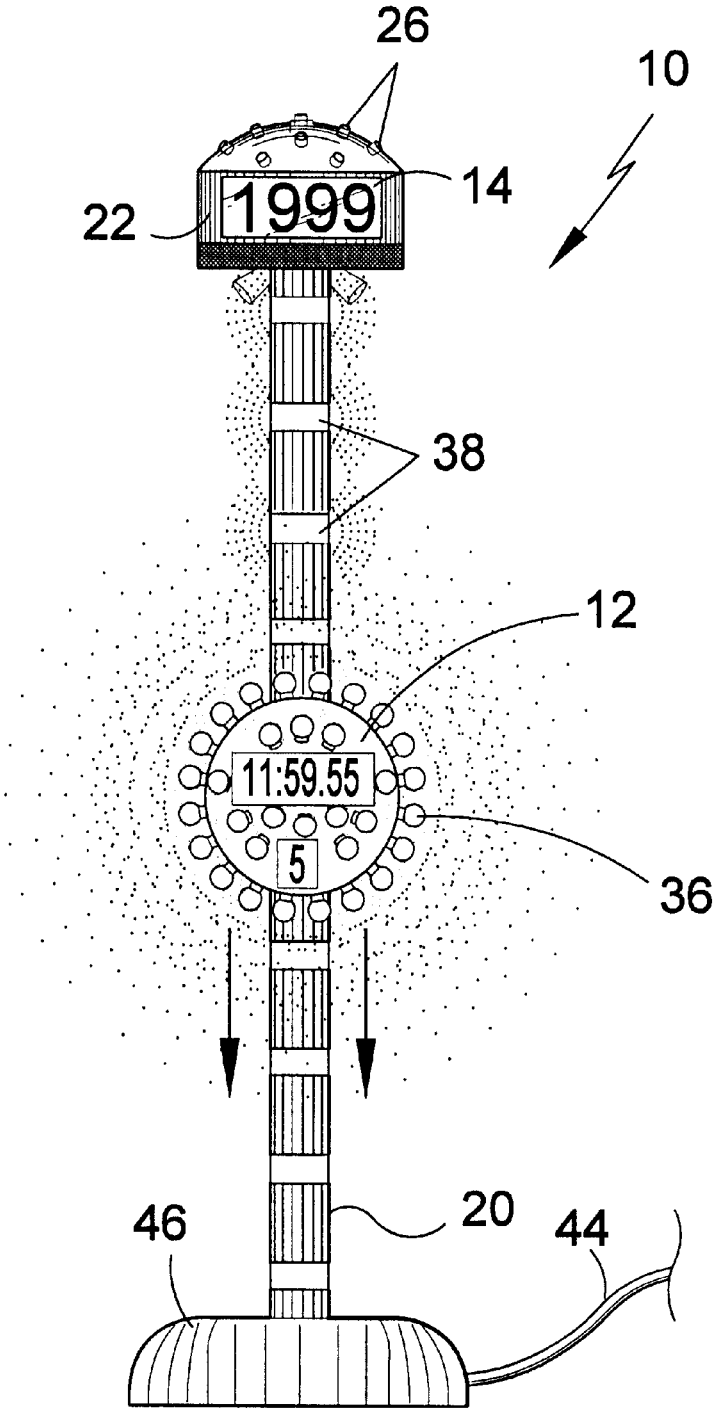
FIG. 3 is a front view of the present invention in operation; shown is the ball in mid-descent with five seconds remaining until midnight. The vertical post lamps light up and remain lit after the ball passes over them.

Turning to FIG. 3, shown therein is a front view of the present invention 10 in operation. Shown is the ball 12 in mid-descent with five seconds remaining until midnight. The vertical post lamps 38 light up and remain lit after the ball 12 passes over them. Elements previously disclosed are also shown.

Figure 4:
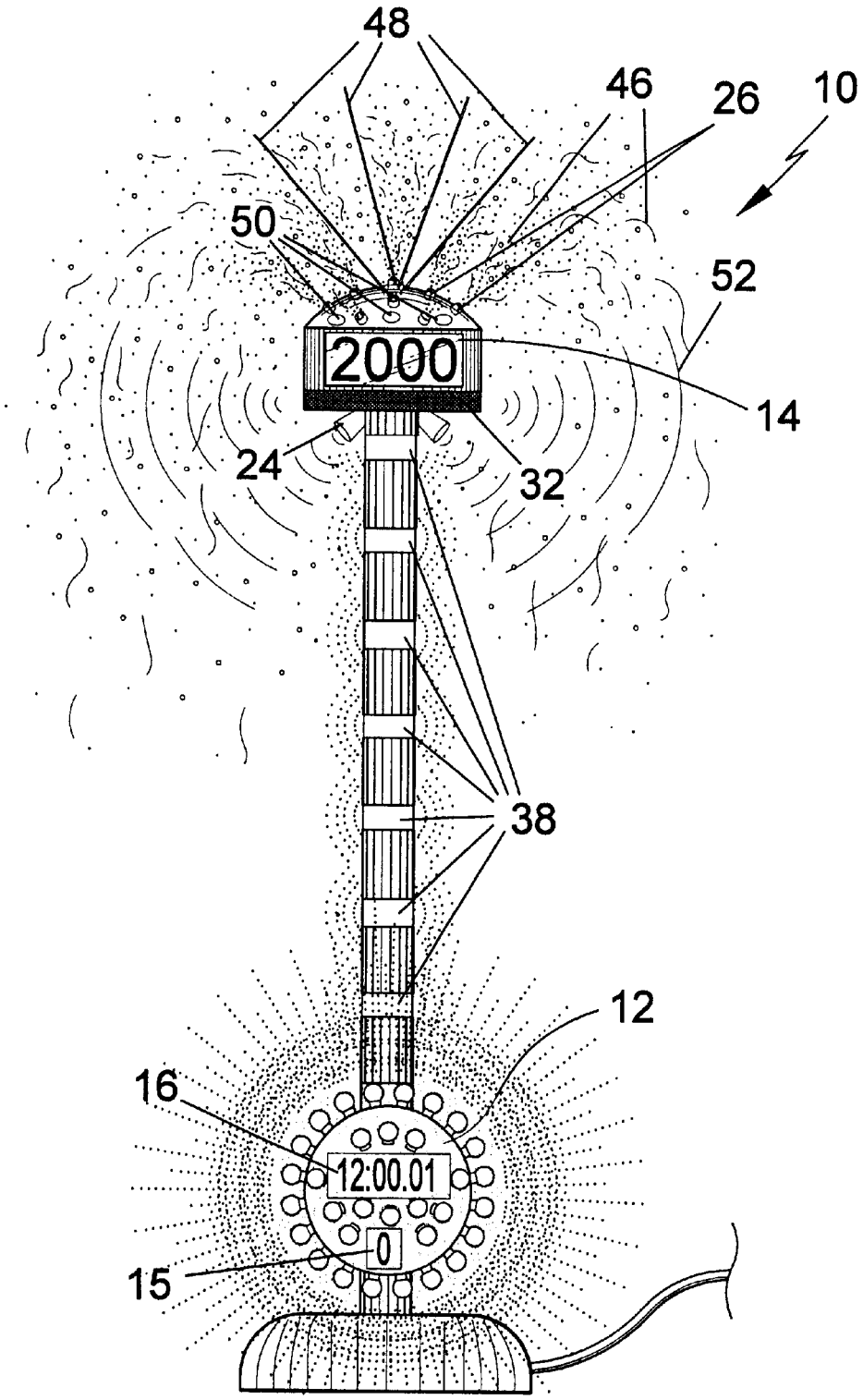
FIG. 4 is a front view of the present invention in full operation after the ball has reached its destination. The confetti blower is spraying confetti into the air amid laser and halogen lighting and the lamps on the pole and the ball are flashing along with sirens and music that is playing over the P.A. The year designation display has changed to show the new year.

Turning to FIG. 4, shown therein is a front view of the present invention 10 in full operation after the ball 12 has reached its destination. The confetti blower 26 is spraying confetti and glitter 46 into the air amid laser lights 48 and halogen lighting 50 and the lamps 38 on the pole and the ball 12 are flashing along with sirens 24 and music that is playing over the P.A. system speakers 32. The flashing lamps 38 could flash in sequence, as a strobe, or be steady on. The year designation 14 display has changed to show the new year. Sound waves 52 are shown representing music from the P.A. Digital displays 15, 16 are also shown displaying the time until the celebration.

What is claimed to be new and desired to be protected by Letters Patent is set forth in the appended claims.

I claim:

1. An apparatus for a celebratory device, comprising:

a) a generally vertically standing support pole having a top end and a base end;

b) a housing disposed on said top end of said support pole, said housing having a plurality of nozzles disposed therein;

c) a confetti blower disposed internal said housing, said confetti blower for blowing confetti out said plurality of nozzles;

d) a track mechanism disposed on said support pole;

e) a ball vertically movably disposed on said support pole being vertically movable on said track mechanism;

f) a plurality of lamps disposed on said ball;

g) a base stand upon which said support pole is mounted;

h) means for a drive mechanism for said ball;

i) means for electronically controlling the apparatus; and, j) a source of electrical power for the apparatus.

2. The apparatus of claim 1, said housing further comprising a means for a laser generator whereby laser light beams could be selectively radiated from said housing.

3. The apparatus of claim 1, said housing further comprising a means for a halogen generator whereby halogen light beams could be selectively radiated from said housing.

4. The apparatus of claim 1, said housing further comprising means for a public address system.

5. The apparatus of claim 4, said means for a public address system further comprising a speaker means.

6. The apparatus of claim 4, said means for a public address system further comprising an amplifier means.

7. The apparatus of claim 1, said housing further comprising means for a light emitting diode.

8. The apparatus of claim 1, said ball further comprising means for a plurality of externally projecting lamps.

9. The apparatus of claim 1, said ball further comprising means for a light emitting diode.

10. The apparatus of claim 1, said support pole further comprising means for pole lamps.

11. The apparatus of claim 10, wherein said pole lamps are spaced apart on said support pole between said housing and said base.

12. The apparatus of claim 11, wherein said pole lamps are disposed internally of said support pole.

13. The apparatus of claim 1, further comprising means for connection to the internet whereby accurate time may be obtained for operation of the apparatus.

14. The apparatus of claim 1, further comprising means for connection to a cable TV output whereby accurate time may be obtained for operation of the apparatus.

15. The apparatus of claim 14, said housing further comprising means for a public address system, said means for connection to a cable TV output further comprising means for connecting said cable TV output to said public address system.

* * * * *